US010900665B2

(12) United States Patent
Flesch et al.

(10) Patent No.: US 10,900,665 B2
(45) Date of Patent: Jan. 26, 2021

(54) COMBINATION APPLIANCE HAVING A COOKTOP AND STEAM EXTRACTION DEVICE

(71) Applicant: BSH Hausgeräte GmbH, Munich (DE)

(72) Inventors: Sebastien Flesch, Gerstheim (FR); Yves Lebrun, Eschau (FR); Gert Meinhardt, Gondelsheim (DE); Daniel Metz, Karlsdorf-Neuthard (DE)

(73) Assignee: BSH Hausgeräte GmbH, Munich (DE)

( * ) Notice: Subject to any disclaimer, the term of this patent is extended or adjusted under 35 U.S.C. 154(b) by 184 days.

(21) Appl. No.: 15/753,180

(22) PCT Filed: Aug. 5, 2016

(86) PCT No.: PCT/EP2016/068773
§ 371 (c)(1),
(2) Date: Feb. 16, 2018

(87) PCT Pub. No.: WO2017/029134
PCT Pub. Date: Feb. 23, 2017

(65) Prior Publication Data

US 2018/0306449 A1 Oct. 25, 2018

(30) Foreign Application Priority Data

Aug. 19, 2015 (EP) ..... 15290211

(51) Int. Cl.
*F24C 15/20* (2006.01)

(52) U.S. Cl.
CPC ..... *F24C 15/2042* (2013.01); *F24C 15/2035* (2013.01); *F24C 15/20* (2013.01); *F24C 15/2071* (2013.01)

(58) Field of Classification Search
CPC .. F24C 15/20; F24C 15/2042; F24C 15/2035; F24C 15/10

(Continued)

(56) References Cited

U.S. PATENT DOCUMENTS 2,674,991 A 2/1951 Schaefer
3,409,005 A * 11/1968 Field ..... F24C 15/2042 126/300

(Continued)

FOREIGN PATENT DOCUMENTS

CN 202442381 U 9/2012
DE 102013007722 A1 11/2014
JP 2016/068773 A 10/2016

OTHER PUBLICATIONS

International Search Report PCT/EP2016/068773 dated Oct. 10, 2016.
National Search Report CN201680048616.3 dated Nov. 20, 2018.

*Primary Examiner* — David J Laux
*Assistant Examiner* — Nikhil P Mashruwala
(74) *Attorney, Agent, or Firm* — Michael E. Tschupp; Andre Pallapies; Brandon G. Braun

(57) ABSTRACT

A combination appliance includes a cooktop having an opening representing a suction opening of the combination appliance. Arranged below the cooktop is a steam extraction device for suctioning air from a space above the cooktop via the opening. The steam extraction device includes a single blower having an air inlet opening and arranged in the combination appliance such that the air inlet opening of the blower faces the cooktop.

12 Claims, 4 Drawing Sheets

(58) Field of Classification Search
USPC ..... 126/299 D
See application file for complete search history.

(56) References Cited

U.S. PATENT DOCUMENTS

| | | | | | |
|---|---|---|---|---|---|
| 3,587,555 | A * | 6/1971 | Cerola | F24C 15/18 | 126/11 |
| 4,431,892 | A * | 2/1984 | White | F24C 15/101 | 126/299 D |
| 4,446,849 | A * | 5/1984 | McFarland | F24C 15/2042 | 126/299 R |
| 4,562,827 | A * | 1/1986 | Cerola | F24C 15/2042 | 126/299 R |
| 4,899,028 | A * | 2/1990 | Arai | F24C 15/101 | 126/21 A |
| 5,884,619 | A * | 3/1999 | Terry | F24C 15/2042 | 126/299 D |
| 6,455,818 | B1 * | 9/2002 | Arntz | F24C 15/2042 | 126/299 R |
| 6,820,609 | B2 * | 11/2004 | Woodall, III | F24C 15/20 | 126/299 D |
| 2006/0150965 | A1 * | 7/2006 | Kim | F24C 15/2042 | 126/299 D |
| 2010/0163549 | A1 * | 7/2010 | Gagas | H05B 6/1209 | 219/622 |
| 2014/0048057 | A1 * | 2/2014 | Bruckbauer | F24C 15/2042 | 126/299 D |
| 2018/0209662 | A1 * | 7/2018 | Adam | F24C 15/2035 | |
| 2018/0229171 | A1 * | 8/2018 | Adam | F24C 15/2042 | |

* cited by examiner

COMBINATION APPLIANCE HAVING A COOKTOP AND STEAM EXTRACTION DEVICE

CROSS-REFERENCES TO RELATED APPLICATIONS

This application is the U.S. National Stage of International Application No. PCT/EP2016/068773, filed Aug. 5, 2016, which designated the United States and has been published as International Publication No. WO 2017/029134 A1 and which claims the priority of European Patent Application, Serial No. 15290211.0, filed Aug. 19, 2015, pursuant to 35 U.S.C. 119(a)-(d).

BACKGROUND OF THE INVENTION

The present invention relates to a combination appliance having a cooktop and steam extraction device.

In kitchens it is known to use so-called downdraft fans instead of steam extraction hoods which are arranged above a cooktop, for example on the room wall or ceiling, in order to suction fumes and vapors which are produced during cooking. For example, such downdraft ventilation is disclosed in DE 10 2013 007 722 A1. In this case, a cooking steam inlet opening placed in the cooktop plane is connected to a vacuum source via an exhaust air channel system. The downdraft ventilation is in this case provided as a separate appliance between two cooktops or adjacent to a cooktop. A drawback with this downdraft ventilation is in the large space requirement which is due to the exhaust air channel system to be provided. Additionally, in this case the space between the inlet opening and the vacuum source is large so that greater requirements are set for the vacuum source which, in particular, may be constituted by a suction blower.

A cooktop with central suctioning of cooking fumes in the downward direction is also disclosed in WO 2012/146237 A1. In this cooktop, one or more openings are incorporated in the region around the geometric surface center of gravity. Devices are provided below the cooktop for the extraction of kitchen fumes. The devices for the extraction of kitchen fumes are preferably constituted by radial fans which are fastened to the lower face of a cooktop housing and via which air is suctioned upwardly from cooking fumes suction chambers located therebelow.

A drawback with this arrangement is that the requirements for the radial fans for producing a sufficient vacuum are increased, in particular, since the flow of cooking fumes has to be deflected.

BRIEF SUMMARY OF THE INVENTION

It is, therefore, the object of the present invention to provide a combination appliance in which fumes and vapors from the space above a cooktop may be suctioned in a simple and reliable manner with a preferably simple construction of the combination appliance.

According to the invention, therefore, the object is achieved by a combination appliance which comprises a cooktop having at least one opening and a steam extraction device arranged below the cooktop for suctioning air from the space above the cooktop via the at least one opening which is the suction opening of the combination appliance. The combination appliance is characterized in that the steam extraction device has a single blower which has an air inlet opening and which is arranged in the combination appliance such that the air inlet opening of the blower faces the cooktop.

The combination appliance according to the invention comprises a cooktop and a steam extraction device. In particular, these two components of the combination appliance are designed as a structural unit. This means that the two components of the combination appliance are indirectly or directly fastened to one another and may be installed as a unit, for example, in a work surface. The combination appliance thus constitutes a mounting unit, i.e. a unit which is assembled or pre-assembled or a unit which is able to be pre-assembled.

According to the invention, the cooktop comprises at least one heating element and preferably a cover plate. The cover plate covers the at least one heating element from above. The size of the heating element or the working radius thereof determines the size of the cooking zone or the cooking area in the cooktop on which the pots or other cooking vessels may be positioned for heating. The heating element may constitute, for example, an induction module. Alternatively, however, the heating element may also be an electronic heating element in the form of a heating coil. Finally, it is also possible that at least one of the heating elements of the cooktop is constituted by a gas burner. In the last-mentioned embodiment, the cover plate does not cover the heating element but at the point of the heating element has a through-opening for the passage of the burner head.

According to the invention, the steam extraction device comprises a blower and preferably additionally an air duct for conducting air out of the combination appliance after exiting the blower.

According to the invention, at least one opening is provided in the cooktop. The opening may preferably be incorporated in the cover plate of the cooktop. However, it is also within the scope of the invention that the opening is formed or the openings are formed by the intermediate space between adjacent heating elements of the cooktop and no cover plate is provided but for example only a frame for the heating elements. Additionally, it is possible that outside the cover plate the cooktop has a housing in which the heating elements are received. In this embodiment, the at least one opening is preferably incorporated in the upper face and the lower face of the housing of the cooktop.

According to the invention, the steam extraction device is arranged below the cooktop. "Arranged below the cooktop" describes a steam extraction device in which at least one part of the blower of the steam extraction device is located further down than the lowest point of the cooktop. In any case, however, the steam extraction device is arranged below the upper face of the cooktop. If the upper face of the cooktop is formed by a cover plate, as preferred according to the invention, the steam extraction device is arranged below the cover plate. The blower of the steam extraction device may be arranged, for example, between two heating elements of the cooktop or may be located completely offset below the heating elements.

Directional information such as "above" and "below" refer to the combination appliance in the assembled and installed state, i.e. in the state in which said combination appliance is incorporated, for example, in a horizontal work surface.

The air from the space above the cooktop and, in particular, fumes and vapors which are produced during cooking, according to the invention are suctioned via the at least one opening of the cooktop. The opening in the cooktop in this case is the suction opening of the combination appliance. In this case, the "suction opening of the combination appliance" describes the opening via which air enters the interior of the combination appliance. Since the opening of the cooktop which is preferably located in the plane of the upper face of the cooktop, in particular the cover plate of the cooktop, constitutes the suction opening, it is not necessary to provide further guide elements, such as for example channels or pipes, which extend upwardly relative to the cooktop. Thus the construction of the combination appliance and the handling thereof are simplified. In particular, pots or other cooking vessels may be displaced substantially freely on the cooktop. However, according to the invention it is possible that elements such as for example a filter unit are provided in the suction opening, said elements optionally protruding slightly over the upper face of the cooktop.

According to the invention, the steam extraction device of the combination appliance has only a single blower. The blower which may also be described as a fan or suction blower, preferably comprises a blower housing which is designed, for example, as a spiral housing or worm housing. A fan wheel is received in the blower housing, said fan wheel being driven via a motor which is also received in the blower housing. The blower housing has an air inlet opening via which suctioned air is able to enter the fan wheel. Moreover, the fan housing comprises an air outlet opening via which air may be vented radially into a discharge channel or directly out of the combination appliance. In a blower which is constituted by a radial blower, the air inlet opening is preferably located in the region of the axis of the fan wheel.

According to the invention, the blower is arranged in the combination appliance such that the air inlet opening of the blower, and in particular of the blower housing, faces the cooktop. "Faces the cooktop" describes an air inlet opening via which air may be suctioned from above into the blower and thus the blower housing. In particular, "faces the cooktop" describes an air inlet opening which is located at the top on the blower and thus on the blower housing. Preferably, the air inlet opening is located parallel to the cooktop and, in particular, to a cover plate of the cooktop. In this case, therefore, the air inlet opening is thus located in the horizontal plane and is oriented upwardly. However, an air inlet opening which is inclined relative to the horizontal on the upper face of the blower may also be regarded as facing the cooktop. The angle of inclination in this case, however, is preferably less than 90° and further preferably less than 45°.

According to the invention, since a combination appliance in which a single blower is used is provided, the air inlet opening thereof facing the cooktop, a series of advantages may be achieved. Since the air inlet opening faces the cooktop, firstly the suctioning of air via the opening(s) in the cooktop may be simplified. In particular, only a slight deflection of the airflow is required. Thus, the requirements for the power of the blower are reduced. Additionally, due to the alignment of the blower with an upwardly facing air inlet opening, the size of the blower may be selected irrespective of the size of the heating elements or the housing of the cooktop. The blower may be fastened to the side of the blower housing which opposes the air inlet opening. In contrast to the prior art, in which the blowers are fastened by the side opposing the air inlet opening to the lower face of the housing of the heating element, in the combination appliance according to the invention, therefore, a larger blower may be used. The blower in this case may be fastened, for example, to the base of an appliance housing of the combination appliance, the surface thereof generally corresponding to the surface of the cooktop. Additionally, according to the invention, it is also possible to fasten the blower to the cooktop, in particular to the lower face of the cooktop and, in particular, a lower face of a cooktop housing via the same side in which the air inlet opening is provided, in a region around the air inlet opening. Also in this embodiment, since the air inlet opening of the blower faces the cooktop, i.e. is oriented upwardly, in particular in one embodiment in which the air inlet opening is located below the at least one opening, the size of the blower may be selected to be large and the blower, for example, may be fastened below two heating elements which are located on opposing sides of the opening. Thus a potentially larger blower may produce the desired airflow, even at a lower speed, and the noise development of the blower is therefore also reduced. Since additionally only one blower is used, the noise development relative to the prior art, in which a plurality of blowers are used, may be reduced further and nevertheless a sufficient and reliable suctioning of air from the space above the cooktop may be achieved. Additionally, the construction of the combination appliance is simplified by the use of a single blower.

According to the invention, since the cooktop and the steam extraction device are also integrated in one appliance, the mounting and/or installation are simplified. In particular, the cooktop and the steam extraction device may be incorporated as a unit in a work surface or other surface and optionally removed. Moreover, by the integration of the two components in a combination appliance the necessary overall height is reduced, since the elements of the components may be provided so as to be oriented toward one another in the combination appliance. The overall height of the combination appliance according to the invention may, for example, be 15 to 30 cm and preferably 20 cm. Thus the combination appliance may be integrated in a simple manner in a kitchen. Finally, since according to the invention the opening in the cooktop forms the suction opening of the combination appliance, the space above the cooktop is free and, therefore, for example pots or pans may be displaced without striking against a component of the steam extraction device as occurs, for example, in upwardly extendable filter elements.

According to one embodiment, in a plan view of the cooktop the air inlet opening of the blower is located at least partially below at least one of the at least one opening. This means that, in a vertical projection of the opening on the blower located below, the air inlet opening of the blower is located at least partially in the surface of the opening. By this alignment, the flow path of the air suctioned via the opening to the air inlet opening is minimized and a sufficient suctioning of air from the space above the cooktop may be ensured.

According to one embodiment, in a vertical plan view of the opening, the entire air inlet opening is located below the opening, i.e. in the surface of the opening.

If a plurality of openings are provided in the cooktop, in a vertical plan view the blower may be located below one of the openings or even below a plurality of openings. Hereinafter, reference is made substantially to an embodiment with one opening in the cooktop. If nothing further is specified, the statements which are made also apply to an embodiment of the combination appliance with a plurality of openings.

According to a further embodiment, however, it is also possible, in a vertical projection of the opening on the plane of the air inlet opening, that the air inlet opening of the blower is located outside the surface of at least one of the at least one opening. Particularly preferably, in this embodiment, in a vertical plan view, the air inlet opening of the blower is located outside the surface of all of the openings, i.e. below none of the openings. In this manner, the blower may be protected in a simple manner from objects falling therein and, in particular, the entry of liquids and thus the reliable function of the steam extraction device may be ensured. The inflow path which in such an embodiment has to be covered by the air suctioned via the opening or openings, is namely longer than in the embodiment in which the air inlet opening, in a vertical plan view, is located in the opening, but by the alignment according to the invention of the air inlet opening in the direction of the cooktop, moreover, only a slight deflection of the flow is required. The embodiment in which the air inlet opening is offset relative to the opening(s) has the further advantage that for the user of the combination appliance, at least in a vertical plan view, the blower is not visible. Additionally, in the laterally offset arrangement of the blower relative to the opening or the openings, the entire space between the opening and the lower face of the combination appliance is available for filters or other air guidance elements.

According to the invention, the cooktop and the steam extraction device may be fastened indirectly or directly to one another. In the case of a direct fastening, for example, the side of the blower of the steam extraction device in which the air inlet opening is provided may be fastened to the cooktop, for example to the lower face of a cooktop housing.

An indirect fastening of the cooktop and the steam extraction device may be implemented, for example, by an appliance housing. In this embodiment, the cooktop and the steam extraction device may be received in a common appliance housing. The appliance housing may in this case, in particular, have a trough shape. At the top the appliance housing is closed by the cooktop and if provided, in particular, closed by the cover plate of the cooktop. Additionally an air outlet is incorporated in the appliance housing. The air outlet may be provided, for example, on the rear face of the appliance housing. Alternatively, however, it is also possible that the air outlet is incorporated on one of the side walls of the appliance housing or in the base of the appliance housing. Preferably at least the steam extraction device of the combination appliance is fastened in the appliance housing. On the one hand, the cooktop may be incorporated from above in the appliance housing and, for example, bear with the cover plate against the upper edge of the walls of the appliance housing. Alternatively or additionally, however, the heating elements of the cooktop may also be fastened, for example, to the inner face of the appliance housing or held there.

Since the cooktop and the steam extraction device are connected together indirectly or directly in the combination appliance, both the assembly and the mounting of the combination appliance is simplified. During the assembly, when providing an appliance housing the relative position between the components of the steam extraction device and the cooktop are already predetermined. During the mounting, in particular when incorporated in a work surface, the components of the steam extraction device and the cooktop incorporated in the appliance housing, or the steam extraction device and the cooktop fastened directly together, may be incorporated in one mounting step in a work surface or a different surface. If the cover plate constitutes a separate component of the cooktop from the heating elements, this may be optionally positioned retrospectively.

According to a preferred embodiment, the cooktop and the steam extraction device of the combination appliance may have a common power connection. This power connection may be provided, for example, on the appliance housing and supply the electrical components of the steam extraction device and the cooktop with power. Moreover, the activation of the components of the steam extraction device and the cooktop may also be implemented by a common control device. For example, in this case the steam extraction device may be actuated according to the operating state of the cooktop.

According to one embodiment, the steam extraction device and the cooktop are received in a common appliance housing and the blower of the steam extraction device is fastened to the base of the appliance housing. In this case, in particular, the side of the blower housing which is opposite the air inlet opening is fastened to the base of the appliance housing. This embodiment has the advantage that the blower may be securely held on the base of the appliance housing. Additionally, in this embodiment the assembly of the combination appliance is further simplified. In particular, for example, the blower may be fastened to the base of the appliance housing before the cooktop is incorporated in the appliance housing. The base in this state is still freely accessible and the assembly thus simplified.

According to one embodiment, at least one of the at least one opening extends over the middle of the surface of the cooktop. In one embodiment, in this case a single opening may be incorporated in the cooktop. This opening may, for example, have a round cross section. Alternatively, however, the opening in this embodiment may also have a quadrangular, in particular rectangular, cross section, for example. In this case, the opening may be a square opening in the middle of the surface of the cooktop. Preferably, however, the opening in this embodiment extends over the depth of the cooktop, i.e. it forms a wide slot which extends from the region of the front face of the cooktop to the region of the rear face of the cooktop. By the provision of an opening which extends over the middle of the surface of the cooktop, an alignment of the opening relative to the cooking zone(s) of the cooktop may be ensured, in which fumes and vapors from cooking vessels may be reliably suctioned on the cooking zone(s) of the cooktop. If, for example, four cooking zones are formed in the cooktop, two cooking zones may be located to the right and two cooking zones to the left of a centrally introduced opening extending over the depth of the cooktop. "The depth of the cooktop" is understood as the direction between the front face of the cooktop and the rear face in the mounted state.

According to one embodiment, the combination appliance comprises at least one cover for covering at least one part of the at least one opening. The shape of the cover is adapted to the shape of the opening in the cooktop. In the case of a round opening, generally a round cover is used. In the case of a rectangular opening in the cooktop, preferably a rectangular cover is used.

The cover is releasable from the combination appliance, in particular removable from the cooktop.

The size of the cover may correspond to the size of the opening. In this case, an entry of liquids and other contaminants into the opening(s) in the state in which the steam extraction device is not in operation, is entirely prevented by the cover. Alternatively, however, it is also possible that the size of the cover is smaller than the size of the opening. In this embodiment, for example in the case of an elongated quadrangular cross section of the opening, the length of the cover may correspond to the length of the opening but the width of the cover may be smaller than the width of the opening. Depending on the positioning of the cover on the opening, on the one hand, a single lateral gap may be formed via which air may enter the combination appliance. Alternatively, however, two lateral gaps which extend over the length of the opening may be formed. The last-mentioned embodiment is preferred, in particular in the case of an opening which extends over the middle of the surface of the cooktop, since as a result specific suctioning from the left-hand and the right-hand cooking zones is possible. The embodiment in which only one gap is formed may be used, for example, in an embodiment in which openings extend along the side edges of the cooktop in the depth direction. In this case, the cover is positioned on the opening such that the gap formed thereby bears against the side of the opening which is adjacent to the cooking zones or is in the vicinity thereof.

According to the invention, however, it is also possible that the cover has dimensions which differ in all surface directions from the dimensions of the opening to which said cover is intended to be applied. For example, a round cover which has a smaller diameter than the diameter of a round opening onto which said cover is intended to be applied may be used. Also, in the case of a rectangular cover, both the width and the length of the cover may be smaller than the corresponding dimensions of the opening. As a result, a peripheral gap is formed around the cover, air being able to enter the opening through said gap.

According to a preferred embodiment, a filter unit is provided between the blower of the steam extraction device and the cooktop. The filter unit is located, in particular, between the at least one opening of the cooktop and the air inlet opening of the blower. "The filter unit" in this case describes a unit which is releasably connected to the combination appliance. In particular, the filter unit is introduced into the opening or the filter units are introduced into the openings. The filter unit may be held on the opening, preferably on the edge of the opening. The filter unit in this case is practically suspended in the opening. The filter unit according to the invention comprises at least one filter element. Additionally, the filter unit preferably comprises at least one filter holder, the filter element being able to be held thereby on the combination appliance, for example on the opening of the cooktop. The filter element may be a flat filter element, for example a filter plate or filter mat.

Alternatively or additionally, however, filter elements which describe a hollow body may also be used. For example, a round length of pipe or a rectangular length of pipe made of filter material may be used. Also other shapes, such as for example two filter elements arranged so as to be inclined to one another, may be used in the filter unit.

The filter material of the filter element may be expanded metal, braided metal or the like.

According to a preferred embodiment, the filter unit comprises a collection area for liquids. "Collection area for liquids" describes a region in which liquids which are discharged from the filter element, and/or enter the interior of the combination appliance in a different manner, may be at least partially collected. The collection area, therefore, preferably has the shape of a trough or groove. Particularly preferably, the collection area is configured on the filter holder. The filter element is held via the filter holder on the combination appliance, in particular on the opening in the cooktop. Since the collection area is configured on the filter holder, a series of advantages may be achieved. Firstly, the filter unit is releasably incorporated in the combination appliance.

Thus when removing the filter unit, for example for cleaning the filter element, the collection area may also be emptied and cleaned. Additionally, when providing the collection area in the filter holder and thus in the vicinity of the filter element, liquids and other contaminants may be reliably collected from the filter element itself.

The blower of the steam extraction device of the combination appliance according to the invention is preferably constituted by a radial blower.

BRIEF DESCRIPTION OF THE DRAWINGS

The invention is described again in more detail hereinafter with reference to the accompanying figures, in which.

DETAILED DESCRIPTION OF EXEMPLARY EMBODIMENTS OF THE PRESENT INVENTION

Figure 1:
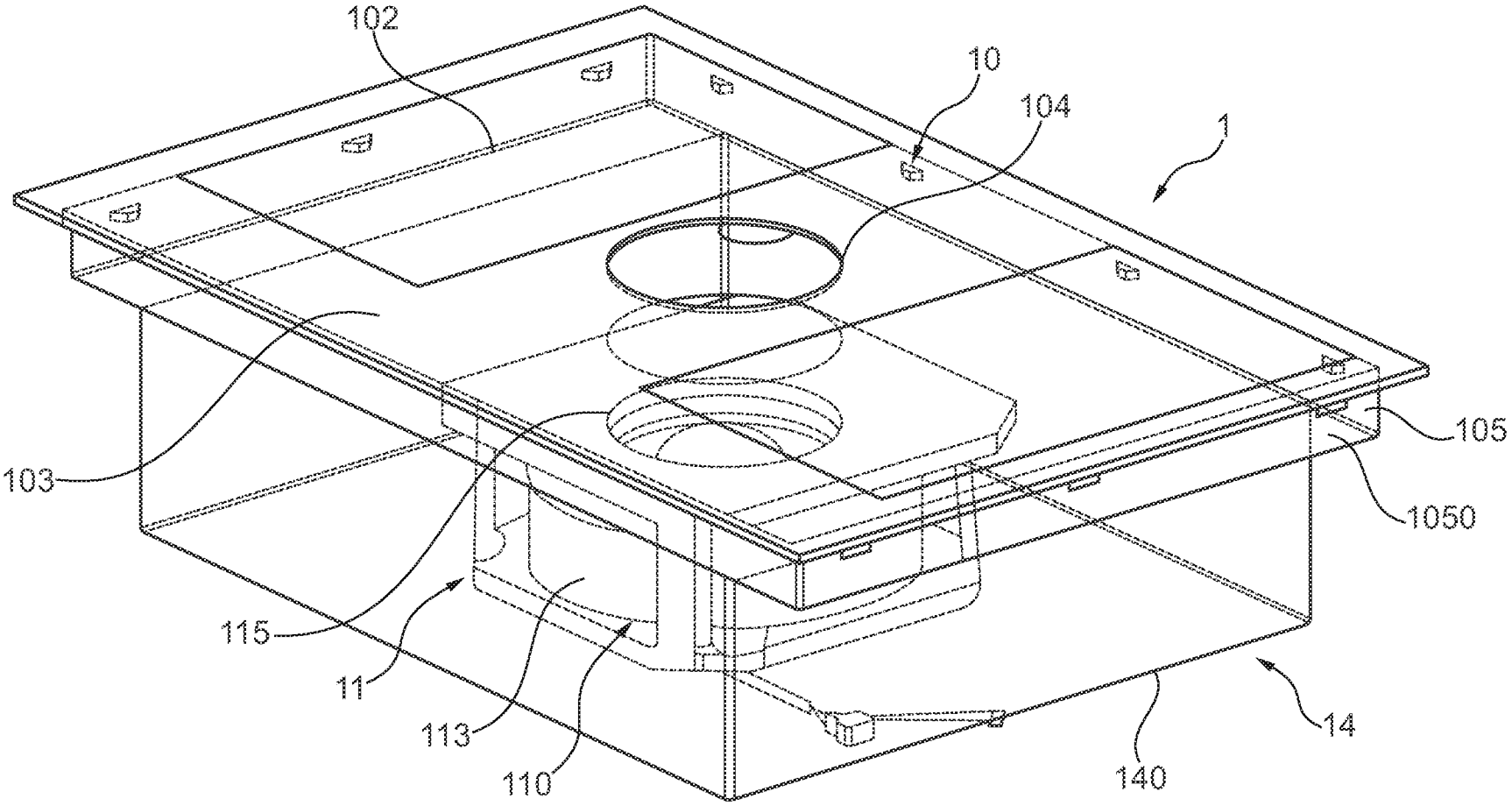
FIG. 1: shows a schematic perspective view of a first embodiment of the combination appliance according to the invention.

In FIG. 1 a first embodiment of a combination appliance according to the invention is shown. The combination appliance 1 comprises a cooktop 10 and a steam extraction device 11. The cooktop 10 is arranged in the upper region of the combination appliance 1. In the embodiment shown the cooktop 10 consists of a cover plate 103 and heating elements (not visible) arranged below the cover plate 103. The region of the cover plate 103 in which a heating element is arranged below the cover plate 103, i.e. on which food to be cooked may be heated, is also described as the cooking zone 102 or cooking point.

The combination appliance 1 comprises an appliance housing 14. In the embodiment shown, the cooktop 10 is positioned on the appliance housing 14. Additionally, in the first embodiment a cooktop housing 105 is provided, the heating elements 101 of the cooktop being received therein and said cooktop housing comprising a base 1050. The cooktop housing 105 may be introduced into the appliance housing 14 or applied thereon. A steam extraction device 11 is provided in the appliance housing 14. In FIG. 1 only the blower 110 of the steam extraction device 11 is visible. The blower 110 is fastened to the appliance base 140 of the appliance housing 14.

As appears from FIG. 1, an opening 104 is incorporated in the middle of the surface of the cooktop 10 and, in particular, in the cover plate 103. In FIG. 1 it is schematically indicated that a further opening corresponding to the opening 104 is provided in the lower face of the cooktop 10, i.e. in the base 1050 of the cooktop housing 105.

The blower 110, in the embodiment shown in FIG. 1, is arranged centrally below the opening 104. In particular, the air inlet opening 115 of the blower housing 113, in a vertical plan view of the opening 104, is located in the surface of the opening 104.

As an alternative to the embodiment shown, in which the cooktop 10 and the steam extraction device 11 are received in an appliance housing 14, according to the invention it is also possible to design the combination appliance 1 without the appliance housing 14. In such an embodiment, for example, the upper face of the blower 110, i.e. the side in which the air inlet opening 115 is provided, may be fastened to the lower face of the cooktop housing 105 in the region which is located outside the air inlet opening 115.

Figure 2:
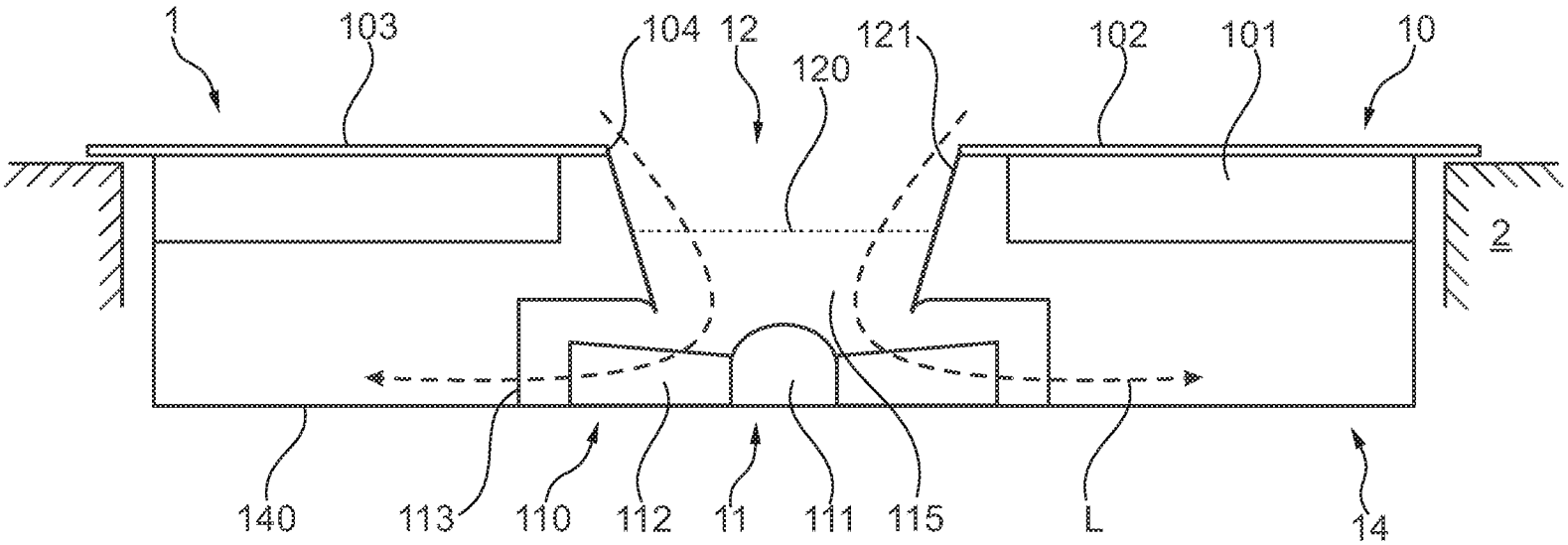
FIG. 2: shows a schematic sectional view of a second embodiment of the combination appliance.

In FIG. 2, a second embodiment of the combination appliance according to the invention 1 is shown.

The second embodiment of the combination appliance 1 also consists of a cooktop 10 and a steam extraction device 11. The combination appliance 1 is incorporated in a work surface 2. In the embodiment shown, in contrast to the first embodiment, the cooktop 10 is partially received in the appliance housing 14. In particular, in the second embodiment the heating elements 101 of the cooktop 10 are incorporated in the upper region of the appliance housing 14. In the lower region, as in the first embodiment, the blower 110 of the steam extraction device 11 is fastened to the appliance base 140 of the appliance housing 14. The combination appliance 1 is closed at the top by a cover plate 103 of the cooktop 10. A cooktop housing 105, in particular a base 1050, is not provided in the second embodiment.

In an embodiment of the combination appliance 1 without an appliance housing 14, the blower may be fastened to the cover plate 103 or a frame (not shown) of the cooktop.

An opening 104 is incorporated in the cover plate 103 of the cooktop 10, said opening also being located in the second embodiment in the middle of the surface of the cooktop 10. The blower 110 is arranged centrally on the appliance base 140 and thus is located centrally below the opening 104. An air inlet opening 115 is formed in the upper face of the blower 110, in particular of the blower housing 113. In the air inlet opening 115 a protective grille (not shown) may be provided. A filter unit 12 is arranged between the opening 104 and the air inlet opening 115. In the embodiment shown, the filter unit 12 comprises a filter holder 121 and a filter element 120 contained therein. In the embodiment shown, the filter holder 121 has a shape tapering conically toward the air inlet opening 115. With a round opening 104 in the cover plate 103, the filter holder 121 in this case may have a frustoconical shape, for example. The filter element 120 is arranged horizontally in the filter holder 121 in the embodiment shown. In the case of a frustoconical filter holder 121, therefore, the filter element 120 may have a round cross section.

In the embodiment shown, the filter holder 121 covers the entire space between the opening 104 and the cover plate 103 and the air inlet opening 115 of the blower 110. The filter unit 12 is releasably provided on the combination appliance 1, i.e. it may be removed therefrom.

Although in the second embodiment the filter unit 12 has been described as consisting of the filter holder 121 and the filter element 120, according to the invention it is also possible that the filter unit 12 only consists of the filter element 120 and the component shown in FIG. 2 as the filter holder 121 is fixedly connected to the cover plate 103 of the cooktop 10, and thus is not included with the releasable filter unit 12.

The function of the combination appliance 1 according to the first and second embodiment is now described again.

In the blower 110, the fan wheel 112 is driven by a motor 111. As a result, air is suctioned into the blower housing 113 via the upwardly facing air inlet opening 115 of the blower housing 113 which thus faces the cooktop 10. The air in this case is suctioned into the combination appliance 1 from above the cooktop 10 through the opening 104 which forms the suction opening of the combination appliance 1. By means of the filter holder 121 or a fixed component which is configured so as to correspond to the filter holder 121 and which extends from the opening 104 to the air inlet opening 115, the air is specifically conducted to the air inlet opening 115. In this case, the suctioned airflow L passes through the filter element 120. The air thus cleaned is blown out radially via an air outlet opening of the blower housing 113 having opposite parallel channels in relation to the cooktop and from there enters, either indirectly via an outlet duct (not shown) or directly to an air outlet (not shown) of the appliance housing 14. From there the air may be discharged into the surroundings or into the space in which the combination appliance 1 is operated.

Since the opening 104 in the cooktop 10 represents the suction opening for the steam extraction device 11 of the combination appliance 1, no components protrude upwardly on the upper face of the combination appliance 1 and pots or pans which are used on the cooking zones 102 of the cooktop 10 may be freely moved.

The opening 104 may be covered by a cover (not shown) at least for the period in which the steam extraction device 11 is not operated.

Figure 3:
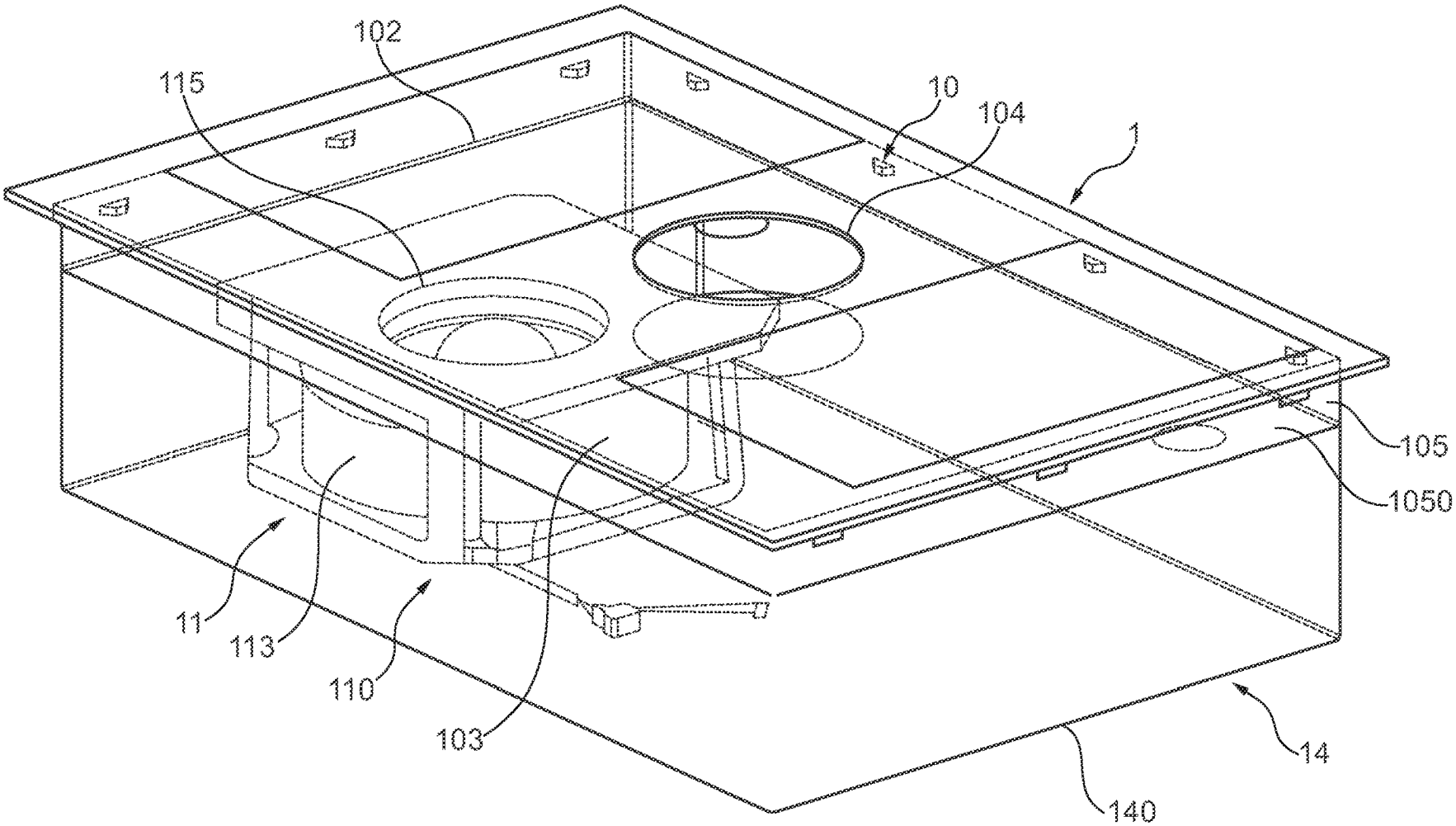
FIG. 3 shows a schematic perspective view of a third embodiment of the combination appliance according to the invention.

In FIG. 3, a third embodiment of the combination appliance 1 according to the invention is shown. This embodiment corresponds substantially to the first embodiment of FIG. 1. However, in the third embodiment in contrast to the first embodiment the blower 110 of the steam extraction device 11 is arranged laterally offset to the opening 104 of the cooktop 10. The air inlet opening 115 of the blower housing 113, therefore, in a vertical projection of the opening 104 on the plane of the air inlet opening 115, is located outside the opening 104.

Figure 4:
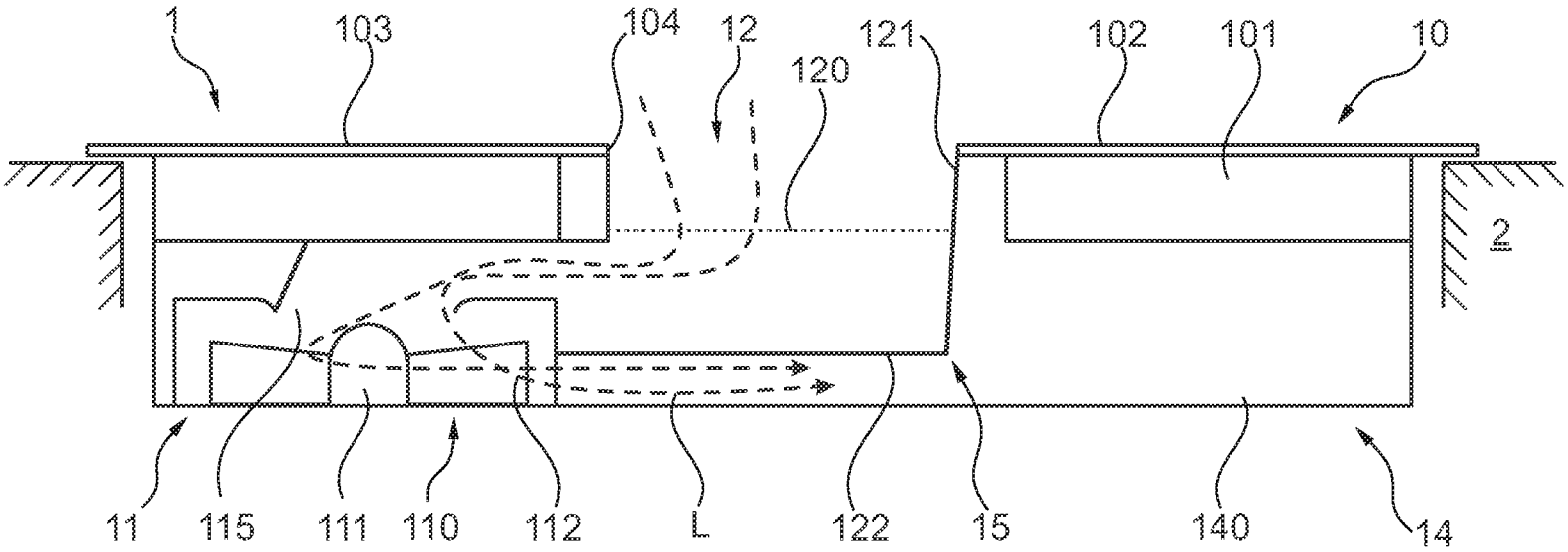
FIG. 4: shows a schematic sectional view of a fourth embodiment.

Also in FIG. 4, in which a fourth embodiment of the combination appliance 1 is shown, the blower 110 is arranged laterally offset to the opening 104. In the embodiment shown, in contrast to the third embodiment, the cooktop 10 is partially received in the appliance housing 14. In particular, in the fourth embodiment the heating elements 101 of the cooktop 10 are incorporated in the upper region of the appliance housing 14. In the lower region, as in the third embodiment, the blower 110 of the steam extraction device 11 is fastened to the appliance base 140 of the appliance housing 14. At the top, the combination appliance 1 is closed by a cover plate 103 of the cooktop 10. A cooktop housing 105, in particular a base 1050, is not provided in the fourth embodiment.

Also, in the fourth embodiment the opening 104 is centrally incorporated in the cover plate 103, i.e. in the middle of the surface of the cooktop 10. The blower 110 in the fourth embodiment is displaced sufficiently far to one side in the appliance housing 14 that, in particular, the air inlet opening 115 and in the embodiment shown also the blower housing 113 are not located below the opening 104.

In the fourth embodiment, an air guidance duct 15 is provided between the opening 104 and the blower 110. In the upper region this air guidance duct serves as a filter holder 121. In the horizontal region which is located below the opening 104, the air guidance duct 15 additionally serves as a collection area 122 for liquids. The air guidance duct 15 terminates at the air inlet opening 115 of the blower housing 113.

By means of the present invention, therefore, a combination appliance is provided in which air, for example, may be suctioned via an opening provided centrally in the cooktop. The air may then pass through a filter and may be suctioned from above into a blower housing. Subsequently, for example, the air may be blown out laterally by the blower and guided out of the combination appliance inside a duct. In this case, the blower may be installed directly below the opening. A protection against the entry of liquids may be provided, for example, by a cover. Alternatively, the blower may also be positioned to the side of the opening. The blower is then no longer visible to the user. In this embodiment a filter element may be designed to be larger/higher.

The invention claimed is:

1. A combination appliance, comprising:

a cooktop having an opening representing a suction opening of the combination appliance; and a steam extraction device arranged below the cooktop for suctioning air from a space above the cooktop via the opening, said steam extraction device including a single blower having an air inlet opening and arranged in the combination appliance such that the air inlet opening of the blower upwardly faces and is parallel to the cooktop, wherein the blower discharges suctioned air through opposite parallel channels in relation to the cooktop.

2. The combination appliance of claim 1, wherein, in a plan view of the cooktop, the air inlet opening of the blower is located at least partially below the opening.

3. The combination appliance of claim 1, wherein, in a vertical projection of the opening on a plane of the air inlet opening, the air inlet opening of the blower is located outside a surface of the opening.

4. The combination appliance of claim 1, wherein the cooktop and the steam extraction device are connected together directly or indirectly.

5. The combination appliance of claim 1, further comprising a common appliance housing configured to connect the cooktop and the steam extraction device.

6. The combination appliance of claim 1, wherein the cooktop and the steam extraction device have a common electrical power connection.

7. The combination appliance of claim 5, wherein the blower of the steam extraction device is fastened to a base of the appliance housing.

8. The combination appliance of claim 1, wherein the opening is sized to extend in midsection of the cooktop.

9. The combination appliance of claim 1, wherein the opening has a round or quadrangular cross section.

10. The combination appliance of claim 1, further comprising a cover configured to cover at least part of the opening.

11. The combination appliance of claim 1, further comprising a filter unit arranged between the blower of the steam extraction device and the cooktop.

12. The combination appliance of claim 1, further comprising a collection area arranged between the blower of the steam extraction device and the cooktop for collecting a liquid.

* * * * *